US005713401A

United States Patent [19]

Weeks

[11] Patent Number: 5,713,401

[45] Date of Patent: Feb. 3, 1998

[54] FUEL DISPENSING AND VAPOR RECOVERY NOZZLE

[75] Inventor: Francis Bruce Weeks, Apex, N.C.

[73] Assignee: Emco Wheaton Retail Corporation, Wilson, N.C.

[21] Appl. No.: 577,389

[22] Filed: Dec. 22, 1995

[51] Int. Cl.[6] ..... B67D 5/378

[52] U.S. Cl. ..... 141/59; 141/206; 141/290; 141/302; 141/392

[58] Field of Search ..... 141/59, 206, 287, 141/290, 302, 304, 392

[56] References Cited

U.S. PATENT DOCUMENTS

| | | | |
|---|---|---|---|
| 2,545,233 | 3/1951 | Kaufman | 141/302 |
| 2,723,070 | 11/1955 | Merriam | 141/290 X |
| 3,815,327 | 6/1974 | Viland | 141/290 X |
| 3,899,009 | 8/1975 | Taylor | 141/59 |
| 3,946,771 | 3/1976 | Braun et al. | 141/59 |
| 4,049,029 | 9/1977 | Hansel | 141/206 |
| 4,131,140 | 12/1978 | Deters | 141/206 |
| 4,157,104 | 6/1979 | Lofquist, Jr. | 141/292 |
| 4,351,375 | 9/1982 | Polson | 141/98 |
| 4,429,725 | 2/1984 | Walker et al. | 141/59 |
| 4,497,350 | 2/1985 | Guertin | 141/206 |
| 4,566,504 | 1/1986 | Furrow et al. | 141/59 |
| 4,649,969 | 3/1987 | McMath | 141/290 |
| 4,697,624 | 10/1987 | Bower et al. | 141/208 |
| 5,038,838 | 8/1991 | Bergamini et al. | 141/59 |
| 5,234,036 | 8/1993 | Butkovich et al. | 141/5 |
| 5,285,826 | 2/1994 | Sanders et al. | 141/59 |
| 5,297,594 | 3/1994 | Rabinovich | 141/59 |
| 5,327,949 | 7/1994 | Dotson et al. | 141/206 |
| 5,390,712 | 2/1995 | Parrish et al. | 141/59 |
| 5,435,357 | 7/1995 | Woods et al. | 141/59 |

*Primary Examiner*—J. Casimer Jacyna
*Attorney, Agent, or Firm*—Merek & Voorhees

[57] ABSTRACT

A fuel dispensing and vapor recovery nozzle having a fuel passageway therethrough, a main valve in the fuel passageway for controlling the flow of fuel therethrough, a manually operable valve actuating lever for opening the main valve, a venturi responsive to fuel flow through the fuel passageway for creating a vacuum, a shut-off passageway from the venturi to the spout adapted to be closed when the fuel tank is filled, a vapor recovery passageway extending longitudinally therethrough and a check valve in the vapor recovery passageway mounted on the spout and having an open condition allowing vapor to pass therethrough and a closed condition so as to block liquid fuel flow through the check valve and out the spout of the nozzle.

3 Claims, 8 Drawing Sheets

FUEL DISPENSING AND VAPOR RECOVERY NOZZLE

FIELD OF THE INVENTION

This invention relates to fuel dispensing systems for dispensing of fuel into a vehicle fuel tank and more particularly to a fuel dispensing and vapor recovery nozzle.

BACKGROUND OF THE INVENTION

Systems for dispensing fuel into vehicle fuel tanks are in common use. These systems typically include a nozzle connected to a pump by a fuel delivery hose. Such nozzles are manually operable and include a spout to be inserted in the fill tube of the vehicle fuel tank. These nozzles include valves under the control of the operator for dispensing fuel through the nozzle into the vehicle tank until the tank is full. Usually a shut-off mechanism is provided and disconnects the manually operable valve lever from the valve when the fuel tank is filled with fuel. Such shut-off mechanisms are typically responsive to fuel flow through the nozzle by a venturi which creates a partial vacuum in a shut-off tube that extends to the outer end of the spout.

Environmental concerns have dictated that fuel dispensing systems include means for recovering vapors from the vehicle tank as such vapors are dispelled by the rising level of fuel being dispensed into the vehicle tank. Examples of such vapor recovery nozzles are disclosed in U.S. Pat. Nos. 4,429,725; 4,649,969; 5,234,036 and 5,390,712. These vapor recovery nozzles all contain vapor recovery passageways either in connection with a balanced pressure vapor recovery system as illustrated by U.S. Pat. No. 4,649,969 or a vacuum assist system as with the other nozzles which utilizes a vacuum pump connected to the vapor recovery passageway to draw vapor from the gasoline tank as fuel is added to the tank.

These previous nozzle designs each include a valve in the vapor recovery passageway. U.S. Pat. Nos. 4,429,725; 5,234,036 and 5,390,712 include a valve in the vapor recovery passageway which is linked to fuel flow. As illustrated in U.S. Pat. No. 5,390,712, the vapor passageway valve is operably linked to the main fuel popper valve so that the vapor recovery passageway is opened whenever the fuel poppet valve is opened. The vapor recovery passageway valves in U.S. Pat. Nos. 4,429,725 and 5,234,036 are opened when fuel pressure is present downstream of the main fuel poppet valve. All of these systems are designed to prevent flow of air or vapor into the vacuum system when no fuel is flowing through the nozzle. In contrast, the check valve in the vapor recovery passageway of U.S. Pat. No. 4,649,969, a non-vacuum assist type nozzle, is provided to close the vapor recovery passageway when the bellows is not in contact with the fill pipe of the vehicle tank. All of these approaches to valves in the vapor recovery passageway have in common that pressure differentials within the vapor recovery passageway are not utilized to activate the valves. This is important because the pressure differential, in both types of vapor recovery systems, is the driving force for vapor recovery and it is, therefore, undesirable to cause any unnecessary pressure drops in the vapor recovery passageway.

U.S. Pat. No. 5,327,949 discusses an attitude sensitive valve in the vapor recovery passageway which includes a spring loaded valve member which opens when vacuum is applied to the vapor recovery passageway. However, the attitude sensitive valve is positioned in the nozzle body closely adjacent the connection to the vapor recovery hose.

While this placement allows the attitude sensitive valve to be exposed to the vacuum source before any pressure drops within the nozzle itself, this position eliminates any potential for the valve to prevent liquid fuel spills through the vapor recovery passageway since the passageway is essentially entirely downstream of the attitude sensitive valve. In addition, the multi-piece spring loaded valve design makes it difficult to establish a minimal spring load to prevent undesirable pressure loss in the vapor recovery passageway.

A problem common to vapor recovery nozzles is that condensation of fuel vapors in the nozzle body or splashing of liquid fuel through the vapor recovery passageway during filling can cause liquid fuel to accumulate in the nozzle which is not evacuated by the vapor recovery system. This liquid fuel can accumulate in chambers in the nozzle body and still be present after the nozzle is removed from the vehicle fill pipe. It can later drain out of the nozzle when a subsequent user changes the orientation of the nozzle causing a fuel spill which may contact the customers clothing and in any event can cause a release of hydrocarbons to the atmosphere as the spilled fuel eventually evaporates.

With the forgoing in mind, it is an object of the present invention to provide a fuel dispensing and vapor recovery nozzle having a check valve in the vapor recovery passageway to prevent inadvertent spills of condensed or splashed fuel after filling operations.

It is a more specific object of the present invention to provide a check valve in the vapor recovery passageway which opens responsive to a positive pressure differential but which does not cause a significant pressure drop in the vapor recovery passageway.

It is a further more specific object of the present invention to provide a check valve in the vapor recovery passageway mounted on the nozzle spout to prevent any fuel which condenses or splashes into portions of the nozzle which will not naturally drain back into the vehicle fill pipe from subsequently draining out of the nozzle and causing an undesirable fuel spill.

SUMMARY OF THE INVENTION

The foregoing objects of this invention are accomplished by a fuel dispensing nozzle including a body portion having a fuel passageway extending therethrough and communicating at its ingress end with a fuel supply hose connected to a dispensing pump. At the egress end of the fuel passageway through the body portion, a spout is mounted on the body portion and has a fuel delivery passageway therethrough which communicates with the fuel passageway in the body portion. A main valve is mounted in the fuel passageway in the body portion and is biased toward the closed position and moved to the open position by a manually operable lever when it is desired to dispense gasoline into the fuel tank of a vehicle.

The nozzle also includes a vapor recovery passageway therethrough which communicates at the ingress end of the body portion with a vapor recovery hose within the fuel delivery hose. At its other end, the vapor recovery passageway of the nozzle communicates with the upper end of the fill tube of the vehicle fuel tank by inlet openings or an elongate inlet opening in the spout. The inlet opening or openings have sufficient cross-sectional area to remove substantially all of the vapor from the vehicle fuel tank. Thus, vapor is recovered along the portion of the spout that is inserted into the fill tube below the restrictor plate and is exhausted into the vapor recovery passage and through the nozzle drawn by vacuum from the vapor recovery system vacuum pump.

A vapor recovery check valve is provided in the vapor recovery passageway mounted to the spout. The check valve has an open condition responsive to a positive pressure differential across the check valve between the end of the vapor recovery passageway adjacent the inlet opening and the end of the vapor recovery passageway adjacent the ingress end of the body portion and a closed condition to block liquid fuel flow through the check valve from the end of the vapor recovery passageway adjacent the ingress end of the body portion. Thus, the vapor recovery system will not operate when a positive pressure differential is not applied across the check valve and condensed or splashed liquid fuel will be prevented from spilling out of the vapor recovery passageway.

In one embodiment of the present invention, a vapor recovery check valve is provided which includes a seal member cantileverly mounted to a check valve body having vapor flow passageways therethrough and a sealing seat on one surface thereof. The seal member is formed from a resilient material which is flexible so as to flex responsive to a positive pressure differential across the check valve which can be provided by a vacuum pump connected to the ingress end of the nozzle or by a positive pressure applied to the inlet opening in the spout. When the positive pressure differential is applied, the seal member flexes away from a closed condition contacting the sealing seat and covering the vapor flow passageways to allow vapor to flow through the vapor flow passageways of the check valve. The seal member is returned to the closed position when no positive pressure is applied by the resiliency of the cantileverly mounted seal member material.

BRIEF DESCRIPTION OF THE DRAWINGS

In the drawings and specifications, there has been set forth a preferred embodiment of the invention, and although specific terms are employed, they are used in generic and descriptive sense only and not for purpose of limitation.

DETAILED DESCRIPTION OF THE PREFERRED EMBODIMENT

Figure 1:
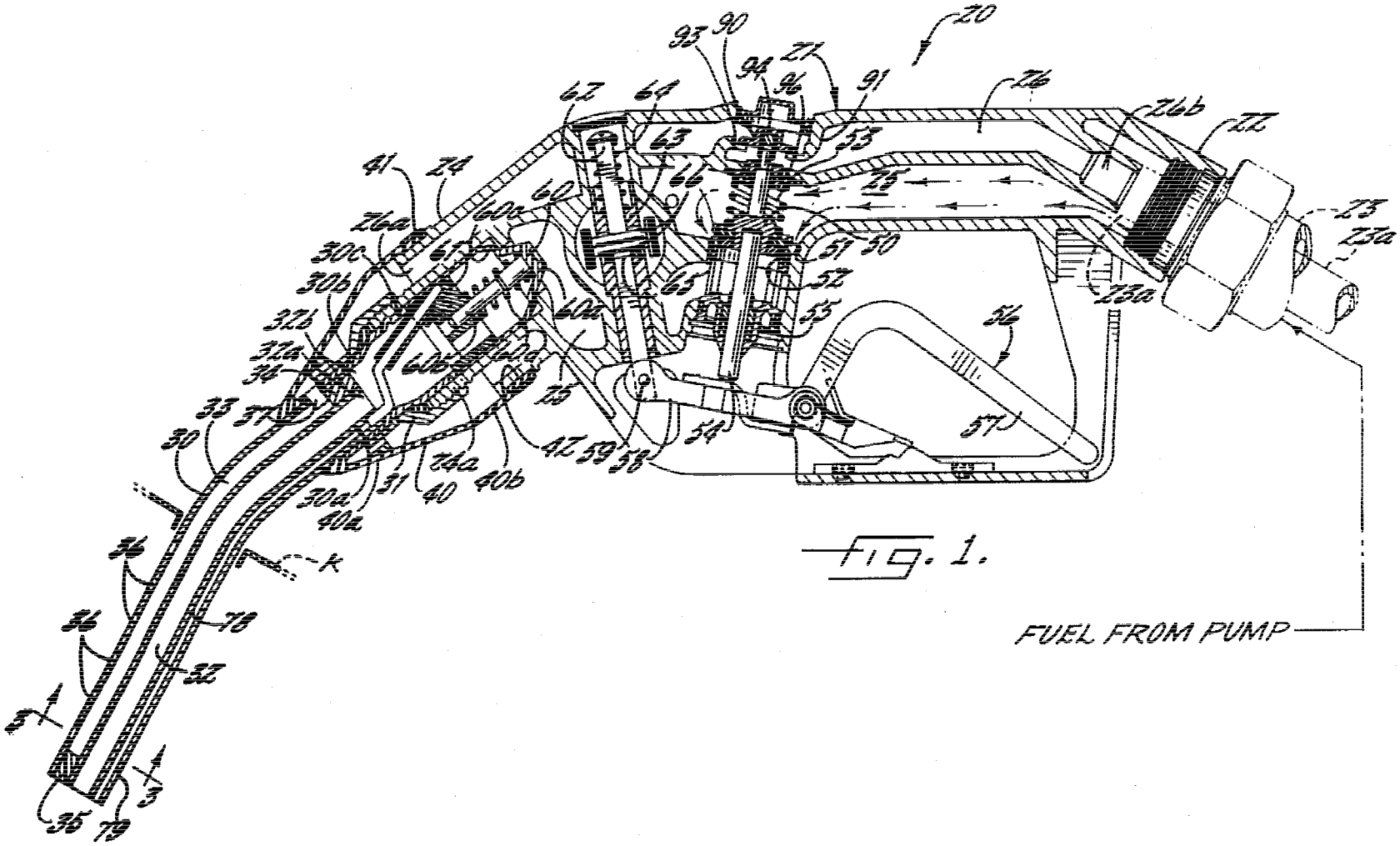
FIG. 1 is a vertical sectional view of a nozzle incorporating the features of the present invention.

Referring now more specifically to the drawings, there is illustrated therein a fuel dispensing and vapor recovery nozzle generally indicated at 20 (FIGS. 1 and 2) which incorporates the features of the present invention. Nozzle 20 includes a body portion 21 which has an ingress end 22 that is adapted to be connected to a fuel delivery hose 23 which in turn is connected to the dispensing pump (not shown) of the service station or the like. Body portion 21 also includes an egress end 24 at the end thereof opposite the ingress end 22.

Body portion 21 has therein a fuel passageway 25 which extends longitudinally through the body portion from the ingress end 22 to the egress end 24. Fuel passageway 25 communicates at the ingress end 22 of the body portion 21 with the fuel conduit in delivery hose 23. Body portion 21 also has a vapor recovery passageway 26 therein which runs longitudinally of the body portion 21 generally parallel to the fuel passageway 25. The vapor recovery passageway 26 is open at the egress end 24 of the body portion 21 as indicated at **26*a* and is connected at its other end 26*b* to a vapor recovery conduit 23*a* within the fuel delivery hose 23. The vapor recovery conduit 23*a* runs axially through the delivery hose 23** to a vacuum pump (not shown) at the underground tank of the fuel delivery system.

A spout 30 is mounted on the egress end 24 of the body portion 21 and specifically on an extension **24*a* which extends outwardly from the main portion of the body portion 21. Extension 24*a* is externally threaded and the fuel passageway 25 extends longitudinally therethrough. Spout 30 includes a body portion 30*a* and a bell-shaped end portion 30*b* fixedly connected to the inner end of the body portion 30*a*, as, for example, by brazing. Spout end portion 30*b* extends into extension 24*a* of body portion 21 and is sealed thereto by an O-ring 30*c*. A spout anchoring nut 31 surrounds the end portion 30*b* of spout 30 and is threadably received on the external threads of the extension 24*a* of the body portion 21**.

Spout 30 includes a fuel passageway 32 extending longitudinally therethrough. Spout fuel passageway 32 has a first passageway portion **32*a* in spout body portion 30*a* and a second passageway portion 32*b* in the bell-shaped end portion 30*b*. Spout passageway portion 32*b* communicates with fuel passageway 25 to receive fuel therefrom. Spout fuel passageway portion 32*a* is open at the terminal outer end of spout 30** to deliver fuel into the vehicle fuel tank.

Spout 30 also includes a vapor recovery passageway 33 therein which extends longitudinally through spout body portion **30*a* and is open at its opposite ends. However, vapor recovery passageway 32 is blocked or closed at its inner end by a plug 34 to prevent vapors from entering the bell-shaped end portion 30*b* of spout 30 and at its outer end by a plug 35 to prevent vapors from entering vapor recovery passageway 33 through the terminal end of spout 30**.

At least one inlet opening 36 is provided through the outer wall of spout 30 into the vapor recovery passageway 33 near but spaced upwardly from the terminal end of spout 30 such that vapors enter the vapor recovery passageway 33 spaced from the terminal end of spout 30. In the embodiment illustrated in FIGS. 1–3 and 6, there are a series of inlet openings 36 spaced along the spout 30 from a point adjacent the terminal end thereof to a point spaced a predetermined distance upwardly and inwardly therealong. The series of spaced inlet openings 36 preferably extend along spout 30 such that the innermost inlet opening 36 will be closely adjacent to but still on the fuel tank side of the restrictor plate R located in the fill tubes of all vehicle fuel tanks. Thus, vapors are recovered from the fuel tank up to and including the space immediately below the restrictor plate R. The total cross-sectional area of inlet openings 36 is such that a substantially unrestricted vapor recovery inlet is provided to passageway 33.

Vapors entering the vapor recovery passageway 33 through inlet openings 36 are exhausted from vapor recovery passageway 33 through an outlet opening 37 formed in the outer wall of spout 30 at a point immediately adjacent plug 34. Preferably, exhaust opening 37 is sufficiently large to provide an unrestricted outlet for the vapors passing through the passageway 33.

The vapors recovered from the vehicle fuel tank and passing through vapor recovery passageway 33 exit through outlet opening 37 externally of the extension 24*a* of body portion 21 and are confined and directed into the end 26*a* of the vapor recovery passageway 26 in body portion 21 by a vapor confinement and directing means 40. Vapor recovery passageway 33 of spout 30, vapor confinement and directing means 40 and vapor recovery passageway 26 of body portion 21 together define the vapor recovery passageway of nozzle 20 which extends from ingress end 22 of body portion 21 and further extends longitudinally through spout 30. Vapor confinement and directing means 40 preferably is in the form of a hollow sleeve which has a frusto-conical section 40*a* and a generally cylindrical section 40*b*. The frusto-conical section 40*a* has its smallest end surrounding the inner end portion of spout body portion 30*a* at a point outwardly of the exhaust opening 37 and in sealing engagement therewith. The cylindrical portion 40*b* of vapor confinement and directing means 40 surrounds the terminal end of the egress end portion 24 of body portion 21. Preferably, the terminal end of egress end portion 24 has an outwardly facing groove 41 formed therein and the cylindrical portion 40*b* of vapor confinement and directing means 40 has an inwardly facing rib 42 which is received in and complements the outwardly facing groove 41 of the terminal end of egress portion 24. Also, a locking ring 42 is received around the cylindrical portion 40*b* opposite the rib 42 to lock cylindrical portion 40*b* into sealing engagement with the terminal end of egress end portion 24. While any locking ring may be employed, a particular example of such a locking ring is an Oeticker clamp.

Figure 7:
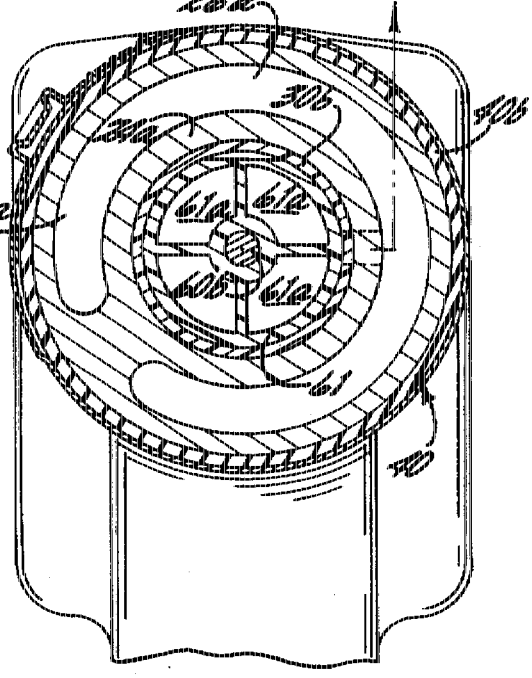
FIG. 7 is an enlarged fragmentary sectional view taken substantially along line 7—7 in FIG. 6.

As shown in FIG. 7, the end 26*a* of vapor recovery passageway 26 is of enlarged cross-sectional area and therefore can receive and confine vapors within that total area without any restriction or other impediment thereto. The main portion of passageway 26 then receives and conveys the vapors through to the end 26*b* thereof where the vapor recovery conduit 23*a* in hose 23 receives and conveys the vapors back to the vacuum pump. The vapor confinement and directing means 40 is formed of a flexible resilient material which is able to withstand substantial physical abuse and the vapors of fossil fuels without deterioration. Also, the same is able to withstand sunlight and other conditions which fuel dispensing nozzles normally encountered in use. One example of an acceptable material of which the fuel confinement and delivery means 40 can be constructed is a synthetic rubber, such as Viton, manufactured and sold by E.I. DuPont de Nemours or a similar material sold by Minnesota Rubber Company.

The body portion 21 and particularly the fuel passageway 25 has a main valve 50 mounted therein which includes a valve member 51 moveable between a closed position in which the valve member 51 is seated against a valve seat 52 surrounding a portion of the fuel passageway 25 and an open position spaced from the valve seat 52. Valve member 51 is biased toward the closed position by a coil spring 53 such that the valve member 51 normally occupies a position seated against the valve seat 52 and closing the fuel passageway 25 through body portion 21.

Figure 11:
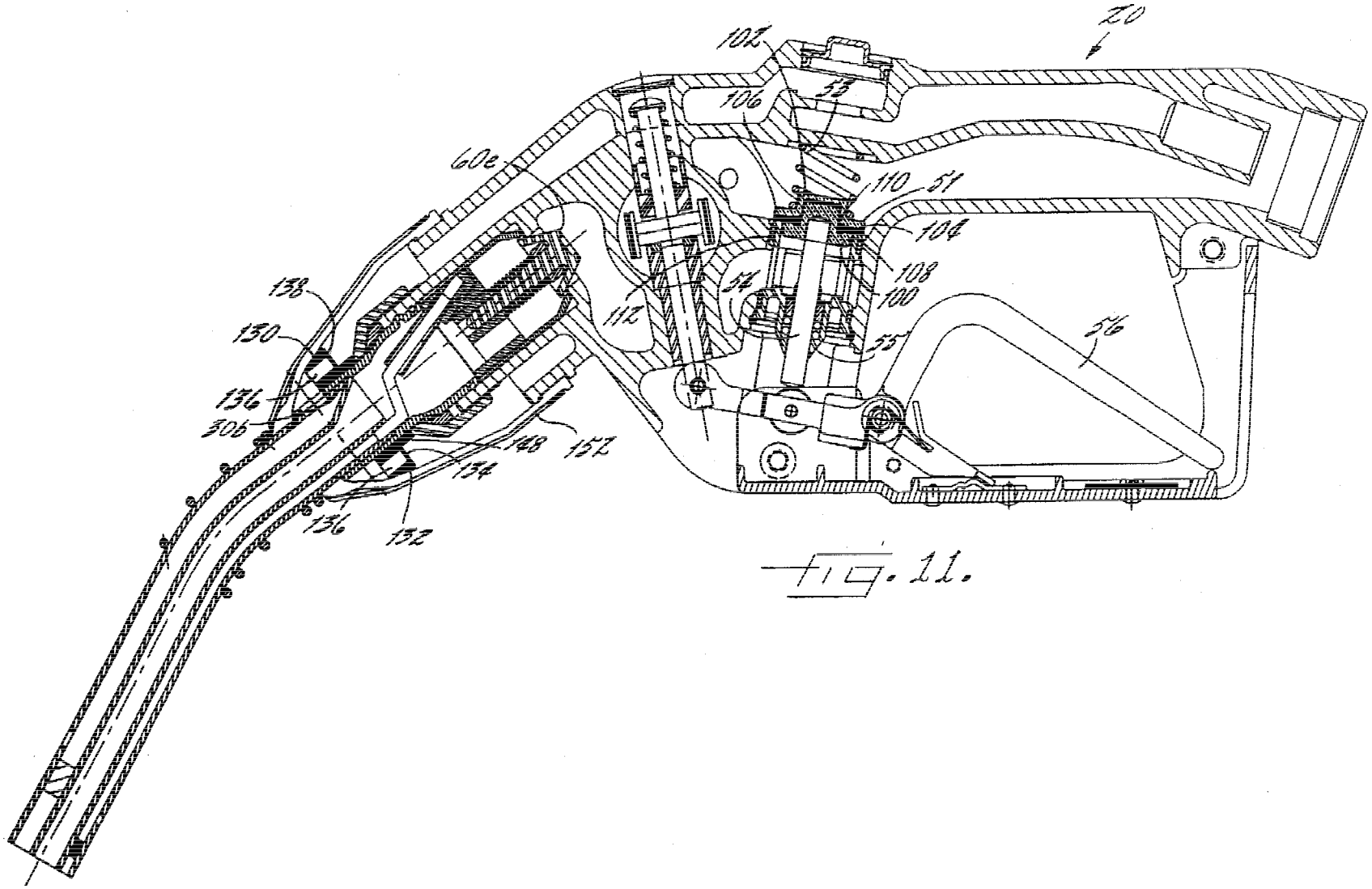
FIG. 11 is a vertical sectional view of the spout of another embodiment of the nozzle of this invention.

Valve member 51 may be comprised of valve mounting member 100, coil spring engaging member 102 and valve seat engaging member 104 as illustrated in FIG. 11. This allows valve seat engaging member 104 to be comprised of a resilient material such as fluorocarbon to provide for effective closing of main valve 50 while valve mounting member 100 and coil spring engaging member 102 are comprised of a rigid, durable material such as aluminum or other metal. Valve mounting member 100 is mounted on valve stem 54 which is slidably mounted for longitudinal movement by valve stem mounting member 55. Valve mounting member 100 further includes central cylindrical portion 106 longitudinally extending from face 108 in a direction opposite the end of valve mounting member 100 connected to valve stem 54 or other valve seat engaging member retaining means. Valve seat engaging member 104 includes a central opening 110 which surrounds the outer surface of central cylindrical portion 106 to restrain movement of valve seat engaging member 104 when valve seat engaging member 104 is mounted over central cylindrical portion 106 and positioned abutting face 108. The outer diameter of valve seat engaging member 104 is greater than the largest outer diameter portion of valve mounting member 100 to define a valve seat engaging portion 112.

Coil spring engaging member 102 includes valve seat engaging member mating face 114 and further includes flange 116 extending from the outer edge of face 114. Face 114 is of a diameter equal to or greater than the outer diameter of valve seat engaging member 104 so that face 114 provides support to valve seat engaging portion 112 when the described embodiment of valve member 51 is assembled as illustrated in FIG. 11. Coil spring engaging member 102 may also include a longitudinally extending central cylindrical portion 118. The outer diameter of portion 118 is chosen to fit within the inner diameter of spring 53.

Figure 12:
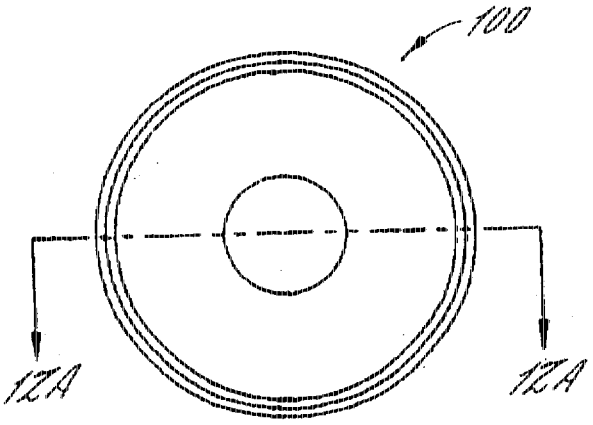
FIG. 12 is an end view of an embodiment of the valve mounting member of the present invention.
Figure 12A:
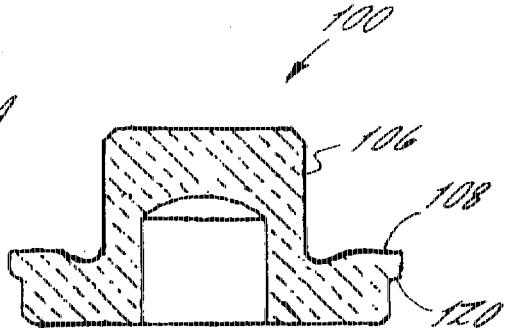
FIG. 12A is a transverse sectional view taken substantially along line 12A—12A in FIG. 12.
Figure 13:
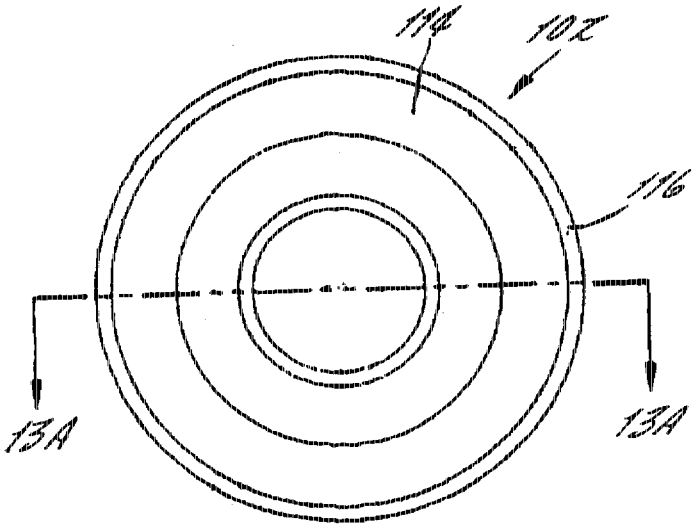
FIG. 13 is an end view of an embodiment of the coil spring engaging member of the present invention.
Figure 13A:
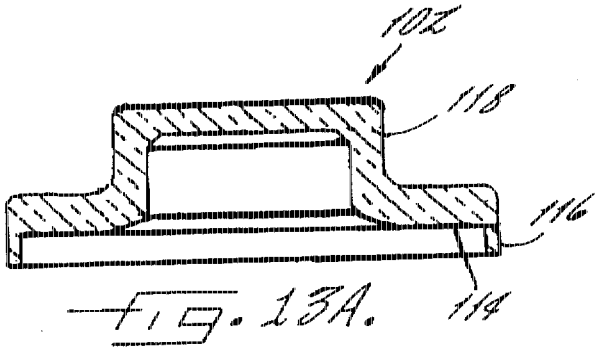
FIG. 13A is a transverse sectional view taken substantially along line 13A—13A in FIG. 13.

As illustrated in FIG. 12A, valve mounting member 100 is provided with a "penny-pincher" capability by providing a region 120 having a decreasing outer diameter extending from face 108. Therefore, as region 102 defines the fuel flow area of main valve 50 during the initial opening of main valve 50, a very small flow rate through main valve 50 is provided for small movements of lever 56. This allows for precise regulation of flow rates.

The outer end of valve stem 54 engages and rests against a valve actuating lever 56 which has a hand engaging portion 57 adapted to be grasped by the fingers of the hand of an operator using nozzle 20. The end portion 58 of lever 56 opposite the hand engaging portion 57 is pivotally mounted by a pivot pin 59. Accordingly, under normal conditions when hand engaging portion 57 is grasped and moved upwardly by an operator, the valve actuating lever 56 pivots about pivot pin 59 and moves valve stem 54 upwardly to move valve member 51 away from valve seat 52 and open main valve 50 to permit fuel to flow through the fuel passageway 25.

A secondary, check valve 60 is mounted in fuel passageway 25 downstream of main valve 50. Check valve 60 includes a valve member 60*a* carried by a valve stem 60*b* and is biased toward a valve seat 60*c* by a spring 60*d*. Valve stem 60*b* is mounted in a check valve mounting member 61 positioned in fuel passageway 25 and having holes 61*a* therethrough (FIG. 7) forming a part of fuel passageway 25.

Fuel check valve 60 faces upstream in fuel passageway 25 and opens when main valve 50 is open and fuel of a predetermined pressure reaches check valve member 60*a*. Once main valve 50 closes and pressure on check valve 60 decreases, check valve 60 will close to prevent any fuel in passageway 25 downstream of main valve 50 from leaking out of nozzle 20. As illustrated in the embodiment of FIG. 11, valve member 60*a* may include passageway 60*e* connecting fuel passageway 25 across check valve 60. Passageway 60*e* provides for initial pressure relief upon nozzle shut-off.

Nozzle 20 is equipped with a automatic shut-off mechanism which will cause main valve means 50 to close once the vehicle tank is full of fuel. Such automatic shut-off means includes an elongate pivot mounting member 62 which carries pivot pin 59 at one end thereof. Pivot mounting member 62 is slidably mounted in a sleeve 63 which in turn is mounted in body portion 21. Preferably, pivot mounting member 62 is rectangular in cross-section such that it cannot rotate relative to the sleeve 63 which itself is fixed against movement in the body portion 21. Pivot mounting member 62 is biased in an upward direction by a coil spring 64 which surrounds the upper end portion of the pivot mounting member 62.

Figure 4:
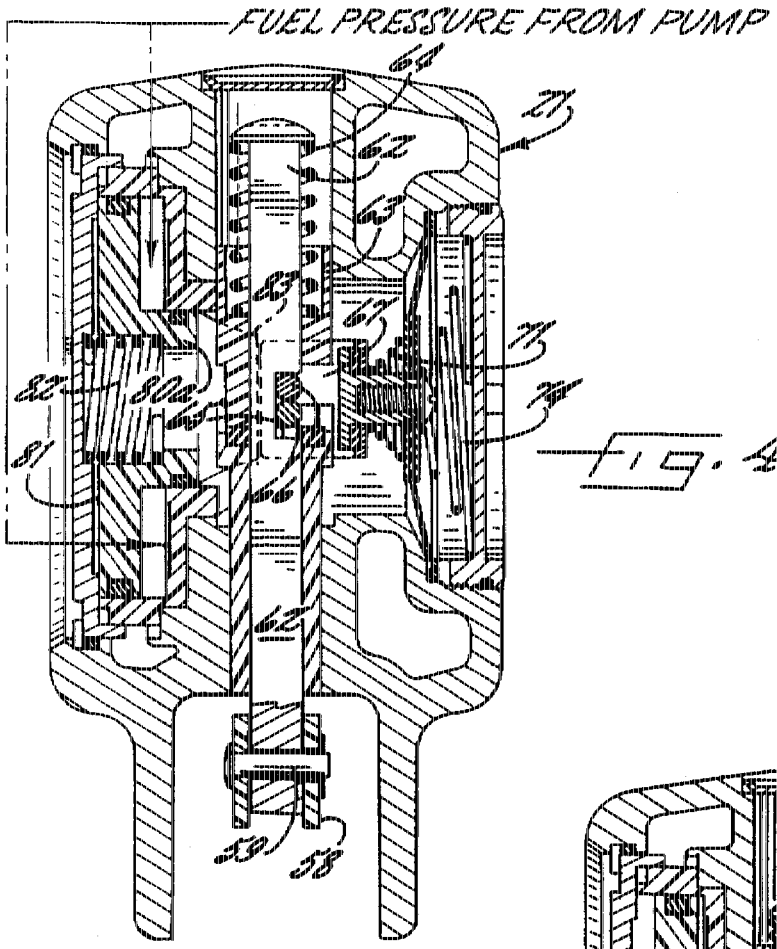
FIG. 4 is an enlarged transverse sectional view taken substantially along 4–4 in FIG. 2.
Figure 5:
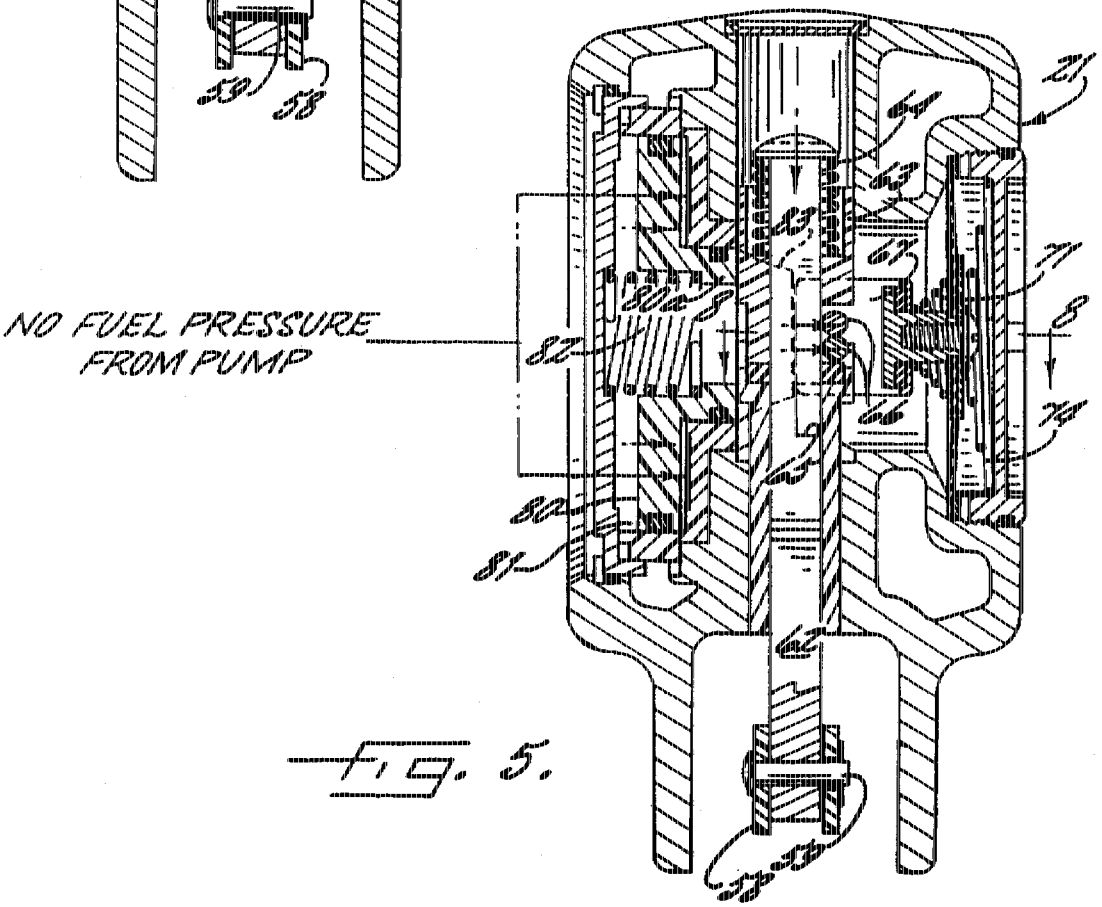
FIG. 5 is a view similar to FIG. 4, illustrating the automatic shut-off mechanism in position shutting off the flow of fuel through the nozzle.
Figure 8:
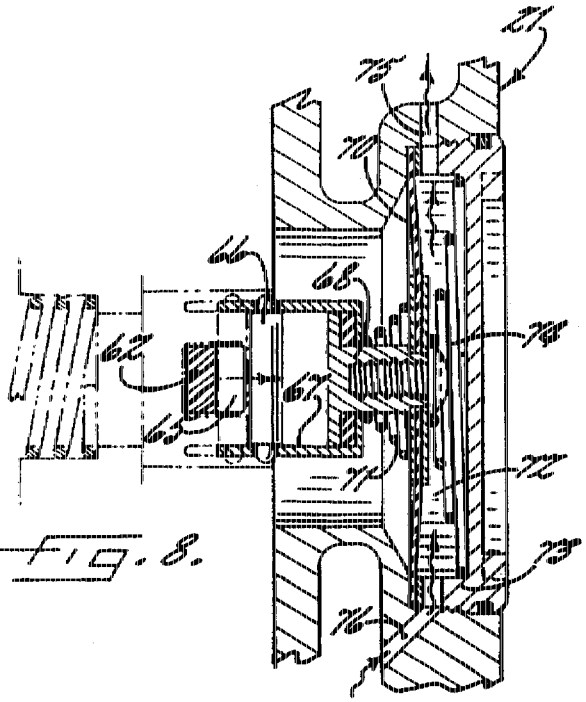
FIG. 8 is an enlarged fragmentary sectional view of the fuel pressure responsive mechanism shown in the left portions of FIGS. 4 and 5.

A groove 65 is located in one side of the pivot mounting member 62 as is best shown in FIGS. 4 and 5. A pair of locking pins 66 are receivable in the groove 65 to hold the pivot mounting member 62 against reciprocatory sliding movement within the sleeve 63. The pins 66 are mounted at their opposite ends in a U-shaped member 67 (FIG. 8). U-shaped member 67 is loosely mounted on a connector member 68 which is connected at its other end to a diaphragm 70. A coil spring 71 is positioned between the U-shaped member 67 and the diaphragm 70 to bias the U-shaped member 67 toward the pivot mounting member 62.

Diaphragm 70 is formed of a flexible resilient material and forms one side of a vacuum chamber 72, the other side and outer periphery of which is defined by a chamber member 73 mounted on body portion 21. Diaphragm 70 may be a molded diaphragm having a convex shape as viewed in FIG. 8 so as to have more flexibility. A coil spring 74 is positioned within chamber 72 and biases the diaphragm 70 toward the pivot mounting member 62 and thereby biases the pins 66 toward the pivot mounting member 62 and toward their operative position within groove 65.

Vacuum chamber 72 is connected at one side thereof to a venturi 75 which communicates at its opposite end with the fuel passageway 25 through body portion 21. The other side of vacuum chamber 72 is communicatively connected to a passageway 76 which in turn is connected by a conduit 77 to the inner end of a shut-off passageway 78 in spout body portion 30*a*. Spout shut-off passageway 78 extends longitudinally through spout 30 from the outer terminal end thereof to the inner end of body portion 30*a*. Therefore, under normal fuel dispensing operation, the outer end of the shut-off passageway 78 is open and air freely passes thereinto and through the conduit 77 and passageway 76 into the vacuum chamber 72. Preferably, a small inlet hole 79 is formed in the side wall of spout 30 adjacent to but spaced a predetermined distance from the outer terminal end of spout 30 to prevent the formation of a vacuum until not only the terminal end of spout 30 is closed by fuel but the entire outer end portion thereof is covered by fuel. Preferably, hole 79 is spaced inwardly from the terminal end of spout 30 approximately one inch.

Figure 9:
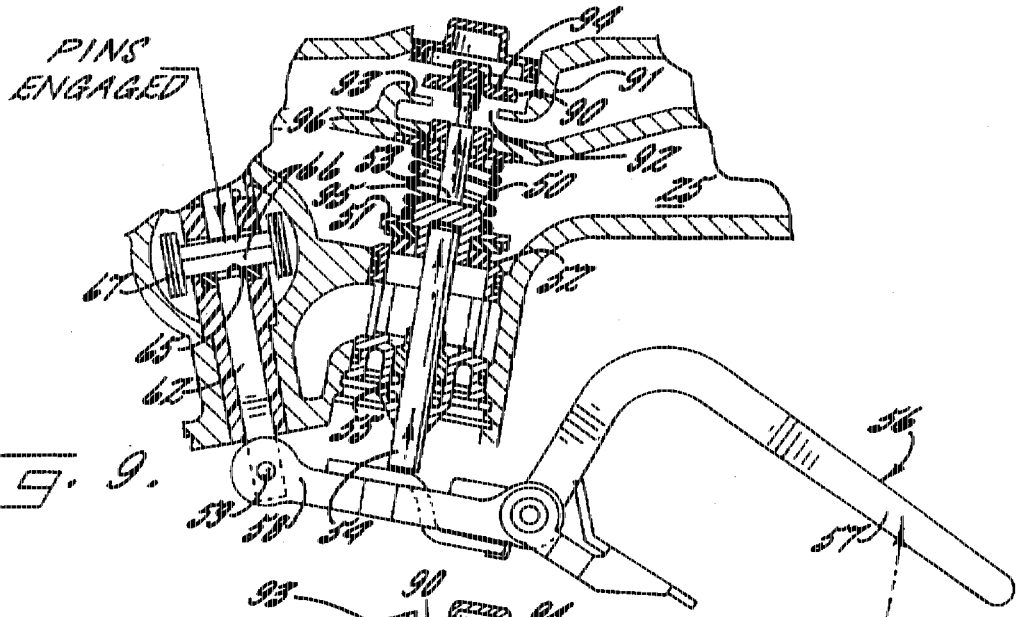
FIG. 9 is an enlarged fragmentary sectional view illustrating the manually operable valve actuating lever, main valve and a portion of the automatic shut-off means shown in the medial part of FIGS. 1 and 2.

When main valve 50 is open and fuel flows through fuel passageway 25 in body portion 21 and through spout 30 into the vehicle fuel tank, the flow of fuel past the venturi 75 creates a partial vacuum in the venturi 75 and thence in the vacuum chamber 72. So long as spout shut-off passageway 78 remains unobstructed, air will flow through spout passageway 78, connector tube 77, and passageway 76 into the vacuum chamber 72 and the diaphragm 70 will be maintained in its normal, inoperative position, as illustrated in FIG. 4. In this position, the pins 66 will be positioned in the groove 65 and the pivot mounting member 62 will be locked against reciprocatory sliding movement and the pivot pin 59 will thus be held stationary (FIG. 9).

Figure 10:
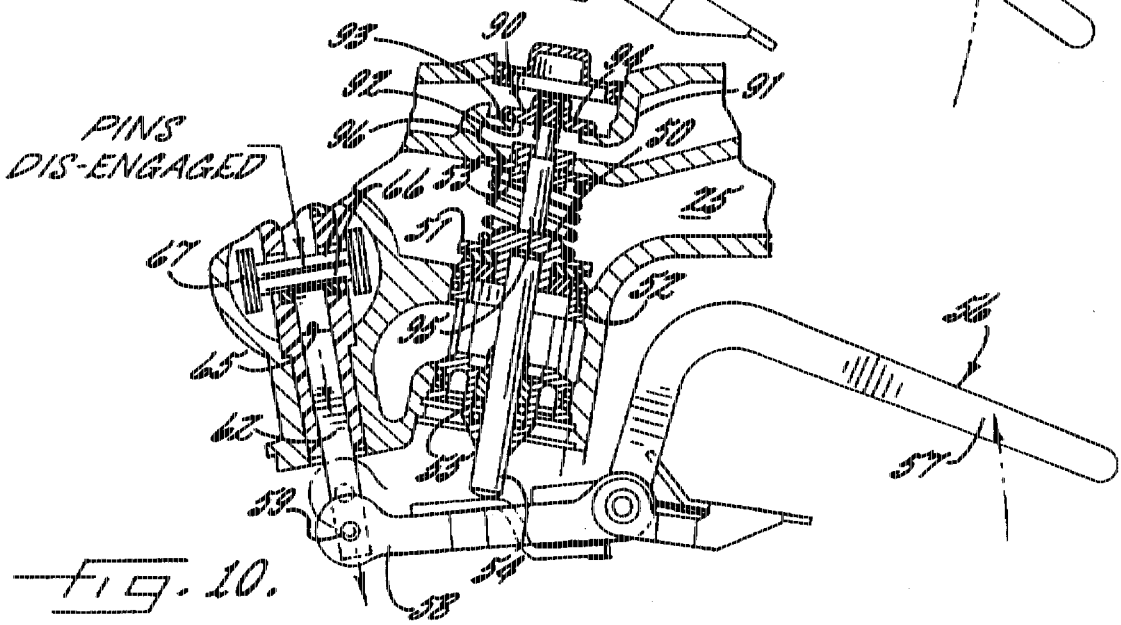
FIG. 10 is a view similar to FIG. 9 illustrating the automatic shut-off means disengaged.

Once the spout shut-off passageway 78 becomes blocked, i.e. both the open terminal end and the hole 79 thereinto, air can no longer enter spout passageway 78 and thence into the vacuum chamber 72. Accordingly, the venturi 75 will draw a vacuum on chamber 72 sufficient to overcome the pressure of spring 74 and cause diaphragm 70 to move to the right as seen in FIGS. 4, 5 and 8. Once diaphragm 70 moves to the operative position, connector member 68 and U-shaped member 67 will withdraw pins 66 from groove 65 in pivot mounting member 62. With pins 66 withdrawn from groove 65, pivot mounting member 62 is free to move downwardly and pivot pin 59 is no longer fixed or held stationary (FIG. 10).

When this occurs, the pivot point for the valve actuating member 56 becomes the end of valve stem 54 and coil spring 53 will be permitted to move valve member 51 against valve seat 52 thereby terminating the flow of fuel through fuel passageway 25 of body portion 21 and fuel passageway 32 of spout 30. Once fuel flow through the fuel passageway 25 ceases, venturi 75 will no longer create a vacuum in vacuum chamber 72 and spring 74 can move diaphragm 70 toward its inoperative position. Such movement of diaphragm 70 causes pins 66 to be moved toward pivot mounting member 62. Because the groove 65 will not be in mating alignment with the pins 66, the U-shaped member 67 cannot move the pins back into the groove 65, but the spring 71 will permit relative movement between the U-shaped member 67 and the connector member 68 such that the pins 66 are spring biased against the side of the pivot mounting member 62. Once the operator releases the hand engaging portion 57 of the valve actuating lever 56, the spring 64 will move pivot mounting member 62 upwardly to bring the groove 65 into alignment with the pins 66 and spring 71 will then move the U-shaped member 67 and pins 66 to the left as seen in FIGS. 4, 5 and 8 to again position pins 66 in grove 65 in pivot mounting member 62. The nozzle 20 will be again ready to dispense fuel into a vehicle tank until the spout shut-off passageway 78 is again blocked.

Nozzle 20 includes a further safety feature which ensures that the nozzle 20 cannot dispense any residual fuel left in fuel passageway 25 or fuel delivery hose 23 when the dispensing pump that supplies fuel through the hose 23 to the nozzle is inoperative. To this end, a fuel pressure sensing member 80 is slideably mounted in a fuel pressure chamber 81 (FIGS. 4 and 5). Pressure chamber 81 is communicatively connected to the fuel passageway 25 in body portion 21. Fuel pressure sensing member 80 is movably mounted in chamber 81 and is biased toward the right as seen in FIGS. 4 and 5 by a coil spring 82. Fuel pressure sensing member 80 has an extension 80*a* extending toward the pivot mounting member 62 and the U-shaped member 67 carrying pins 66. The end of the extension 80*a* engages a spider member 83 which straddles the sleeve 63 and is adapted to engage the U-shaped member 67 and to move the U-shaped member 67 to the right as seen in FIGS. 4, 5 and 8 when fuel pressure sensing member 80 is moved to the right by spring 82.

When the fuel dispensing pump is turned on, the pump will create a fuel pressure through the hose 23 and in the fuel passageway 25 up to the valve member 50 and including the fuel pressure chamber 81. Such pressure will cause the pressure sensing member 80 to move to the left as seen in FIG. 4 against the action of spring 82 which will move the spider member 83 out of contact with the U-shaped member 67 and permit the pins 66 to seat properly within the groove 65 and pivot mounting member 62. The nozzle 20 is thus properly primed for operation to dispense fuel into a vehicle fuel tank.

However, until the dispensing pump is turned on, there is no fuel pressure in fuel passageway 25 nor in chamber 81. Accordingly, spring 82 can move fuel pressure sensing member 80 to the right which will cause the spider member 83 to move the U-shaped member 67 to the right against the action of spring 71 which will move the pins 66 out of groove 65 in pivot mounting member 62. Accordingly, the main valve 50 cannot be opened even if the valve actuating lever 56 is moved upwardly because the pivot pin 59 will move downwardly and no pressure can be applied to the valve stem 54.

In many fuel dispensing systems having vapor recovery capability, the vapor recovery vacuum pump is actuated when the fuel dispensing pump is rendered operative. If the vapor recovery passageway 26 in body portion 21 and passageway 33 in spout 30 are open, undesirable air will be sucked through nozzle 20 and vapor recovery conduit 23*a* into the underground tank. Accordingly, nozzle 20 may optionally include a vapor recovery shut-off means 90 (FIG. 1) for closing the vapor recovery passageway 26 at all times when fuel is not being dispensed into a vehicle fuel tank.

Shut-off means 90 comprises a partition 91 extending laterally across vapor recovery passageway 26 to preclude the passage of vapors through passageway 26 except through an opening 92 in partition 91. A valve seat 93 surrounds opening 92 on the upper side of partition 91 and a valve member 94 normally rests on valve seat 93 and normally closes opening 92. Valve member 94 is carried by the upper end of a valve stem 95, the lower end of which is carried by main valve member 50. Valve stem 95 is mounted for reciprocatory movement by a bearing member 96.

Shut-off means 90 normally closes vapor recovery passageway 26 when main valve 50 is closed and no fuel is being dispensed through nozzle 20. When main valve 50 is opened to dispense fuel through nozzle 20, valve member 94 will be moved upwardly by main valve member 50 moving valve stem 95 upwardly to open the opening 92 through partition 91 and permit the flow of vapors therethrough.

Figures 2, 3:
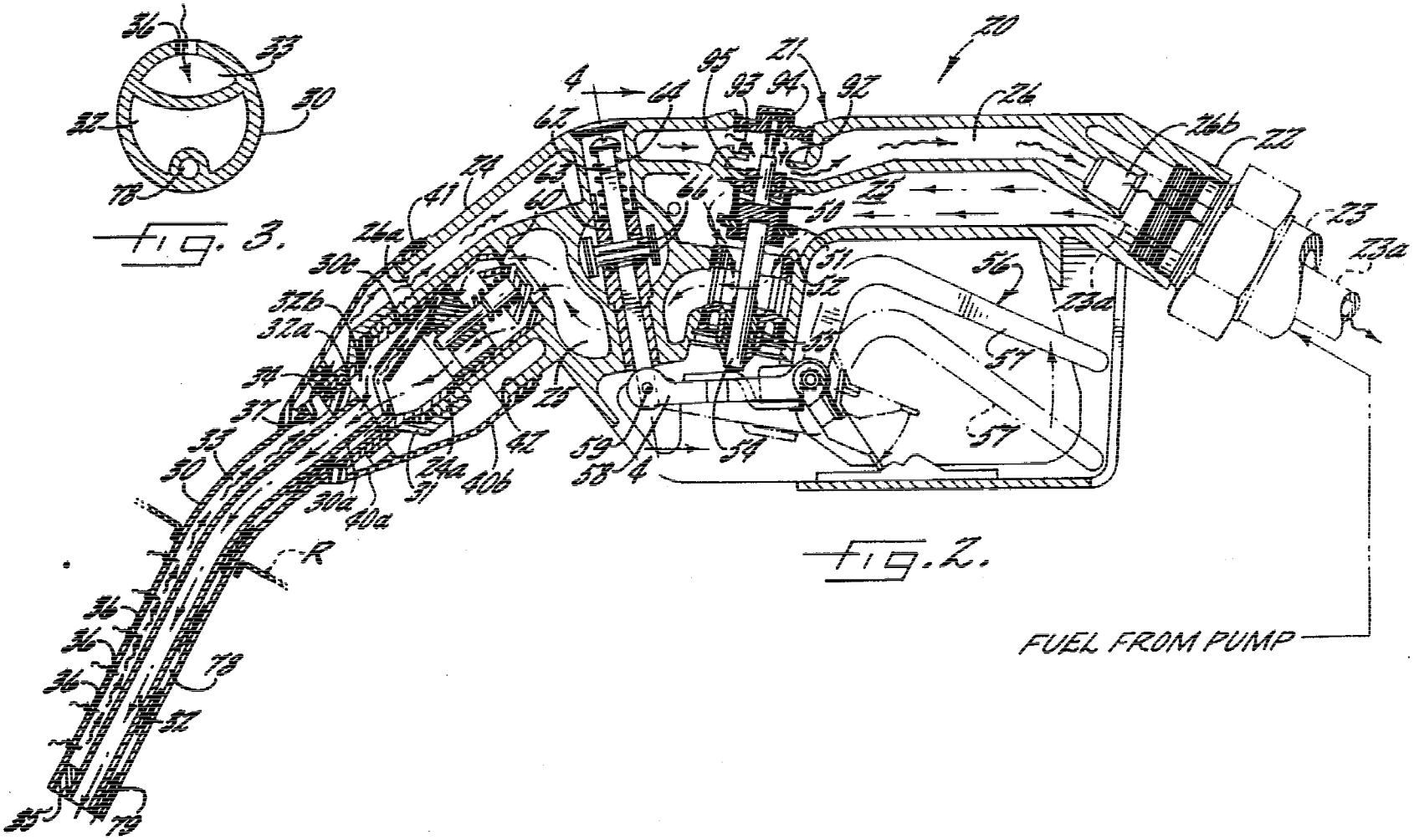
FIG. 2 is a view similar to FIG. 1, illustrating the main valve open and the fuel flowing through the nozzle and vapor being recovered from the vehicle fuel tank.
FIG. 3 is a transverse sectional view taken substantially along line 3—3 in FIG. 1.
Figure 6:
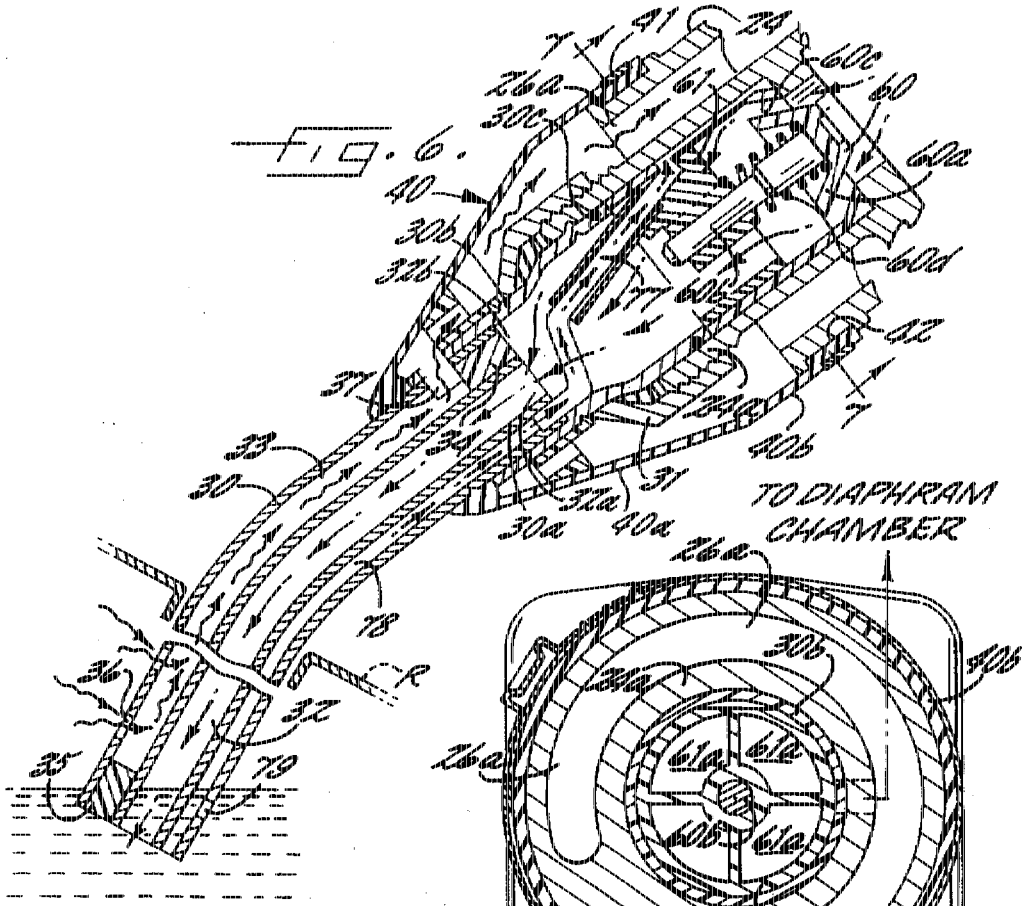
FIG. 6 is a fragmentary sectional view of the spout and vapor recovery confinement means illustrated in the left hand portion of FIG. 2.

According to the present invention, check valve 130 or other flow control means is also provided in the vapor recovery passageway of nozzle 20 positioned adjacent spout 30. FIGS. 1 and 11 illustrate check valve 130 in its closed condition in which it blocks liquid fuel flow through check valve 130 in the direction from ingress end 22 of body portion 21. FIGS. 2 and 6 illustrate check valve 130 in its open condition responsive to a positive pressure differential across check value 130 between the end of vapor recovery passageway 33 adjacent inlet opening 36 and the end of vapor recovery passageway 26 adjacent ingress end 22 of body portion 21.

Figure 14:
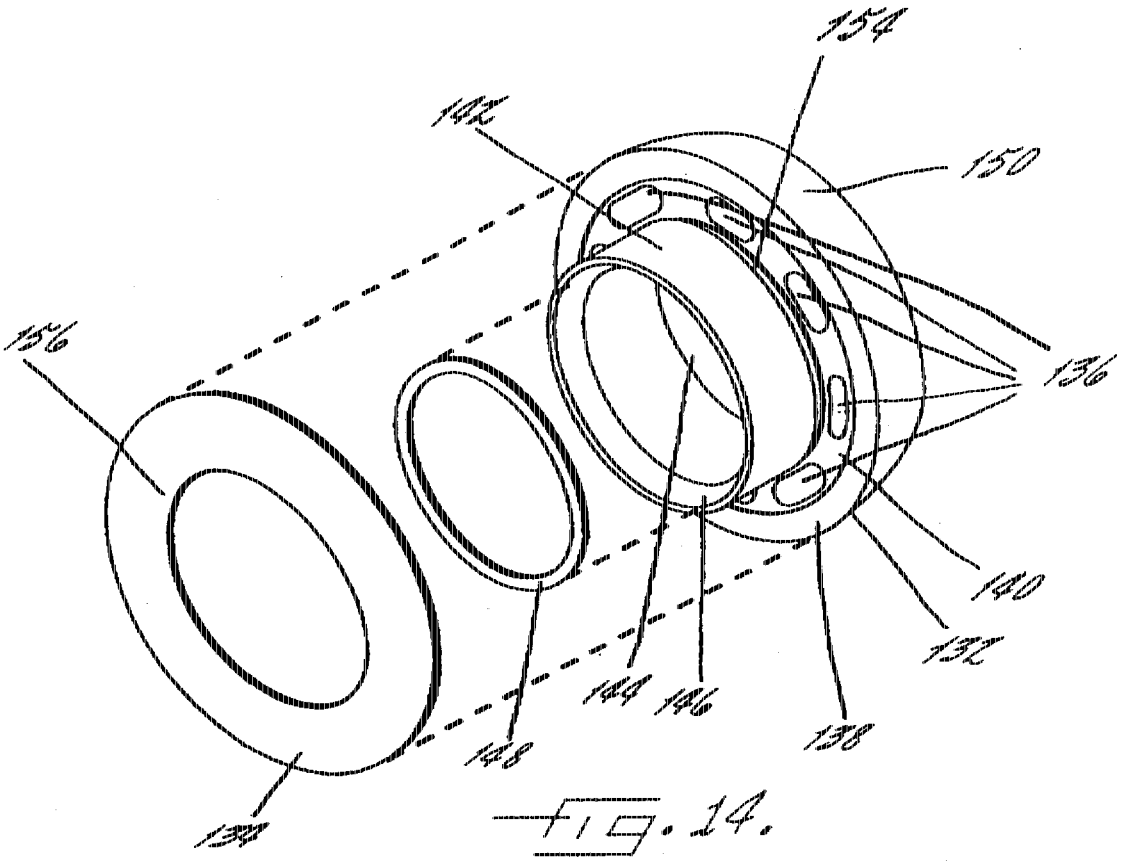
FIG. 14 is an exploded perspective view of an embodiment of the check valve of the present invention.

Referring now to FIGS. 6, 11 and 14, check valve 130 includes check valve body 132 and seal member 134. Check valve body 132 includes longitudinally extending vapor flow passageways 136 extending therethrough to allow vapor to pass through check valve 130. The total cross-sectional area of vapor flow passageways 136 is such that a substantially unrestricted vapor flow path is provided. Check valve body 132 further includes sealing seat 138 on the surface of check valve 130 on the vapor downstream end (vapor flows from inlet opening 36 to end 26*b*) of the vapor recovery passageway of nozzle 20. The vapor flow passageways 136 terminate in groove 140 of sealing seat 138. Cylindrical portion 142 of check valve body 132 longitudinally extends from sealing seat 138. Check valve body 132 also includes longitudinally extending central cylindrical opening 144 which is configured so as to surround and slidably mount on end portion 30*b* of spout 30. Opening 144 terminates at chamfered end portion 146 of cylindrical portion 142.

O-ring 148 is mounted over end portion 30*b* of spout 30 between anchoring nut 31 and chamfered end portion 146 of check valve 130. O-ring 148 provides a sealing means to prevent vapor flow past check valve 130 between spout 30 and central cylindrical opening 144 when check valve 130 is installed in vapor confinement and directing means 40. Check valve body 132 also includes frusto-conical mating surface 150. The angle of frusto-conical mating surface 150 is configured so as to sealingly mate with frusto-conical section 40*a* of vapor confinement and directing means 40. When vapor confinement and directing means 40 is attached with check valve 30 mounted on spout 30 the flexible resilient material of vapor confinement and directing means 40 abuts frusto-conical mating surface 150 with sufficient force to form a seal which prevents vapor flow past check valve 130 between vapor confinement and directing means 40 and frusto-conical mating surface 150. Furthermore, the force applied on frusto-conical mating surface 150 by vapor confinement and directing means 40 presses chamfered end portion 146 of check valve 130 against O-ring 148. As illustrated in FIGS. 6 and 11, protective cap 152 mounts over vapor confinement and directing means 40. Protective cap 152 is formed of a rigid material which protects the flexible resilient material of vapor confinement and directing means 40.

Check valve body 132 also includes mounting groove 154 in cylindrical portion 142. Seal member 134 includes first region 156 defining the inner diameter region of seal member 134 which is cantileverly mounted in groove 154 of check valve body 132. The portion of seal member 134 extending from groove 154 defines a second region which is positioned so as to contact sealing seat 138 when check valve 130 is in the closed condition. Seal member 134 is formed of a resilient material which is flexible so as to flex responsive to a positive pressure differential across check valve 130 between the end of vapor recovery passageway 33 adjacent inlet opening 36 and the end of vapor recovery passageway 26 adjacent ingress end 22 of body portion 21.

Groove 154 is positioned along cylindrical portion 142 to as to establish the loading of seal member 134 against sealing seat 138 in the closed condition of check valve 130. In the embodiment illustrated in FIG. 14, groove 154 is coplanar with the upper surface of sealing seat 138 to provide substantially no spring force between seal member 134 and sealing seat 138 when check valve 130 is in the closed condition. Alternatively, seal member 134 may be provided with a convex shape and groove 154 may be offset away from the plane of sealing seat 138 so as to provide a flexing of seal member 134 in the closed condition of check valve 130 to provide a spring force between seal member 134 and sealing seat 138. However, the greater the force required to flex seal member 134 to move seal member 134 away from sealing seat 138 to allow fuel vapor to pass through check valve 130 in the open condition. the greater the pressure drop across check valve 130. It is desirable that the pressure drop caused by check valve 130 be minimized, preferably less than 0.5 inches H2O (at 80 Cubic Feet Air/Hour) and more preferably less than 0.1 inches H2O.

In operation, when check valve 130 is in its closed condition with no positive pressure across check valve 130, seal member 134 covers vapor flow passageways 136 so as to block liquid fuel flow through vapor flow passageways 136 from the end of the vapor recovery passageway of nozzle 20 adjacent ingress end 22 of body portion 21. When a positive pressure differential is applied, such as when the vacuum pump is turned on in the vapor recovery system of the gas station, the region of seal member 134 extending from groove 154 flexes and moves seal member 134 away from sealing seat 138. Therefore, vapor may flow through vapor flow passageways 136 of check valve 130.

As illustrated in FIG. 14, seal member 134 is a single piece comprised of a resilient material, such as fluorocarbon, and the resiliency of seal member 134 causes the region of seal member 134 extending from groove 154, to return to its position contacting sealing seat 138 and covering vapor flow passageways 136 when there is no positive pressure differential across check valve 130 in the vapor recovery passageway of nozzle 20, for example when the vapor recovery pump is turned off or shut off means 90 is closed. Thus, as illustrated in the embodiment of the nozzle of the present invention shown in FIG. 11, a nozzle may be provided which does not include a separate, fuel flow linked, vapor recovery shut-off means 90.

In the drawings and specification there has been set forth a preferred embodiment of the invention, and although specific terms are employed, they are used in a generic and descriptive sense only and not for purposes of limitation.

That which is claimed is:

1. A fuel dispensing nozzle comprising:

(a) a body portion having a fuel passageway extending from an ingress end to an egress end thereof, the ingress end of said body portion being adapted to be connected to a hose for delivering fuel from a pump to said nozzle, said body portion also having a vapor recovery passageway extending from the egress end to the ingress end thereof, (b) a spout having an inner end carried by the egress end of said body portion and extending outwardly therefrom and terminating in an outer end, said spout including a fuel dispensing passageway extending therethrough from said inner end to said outer end and being communicatively connected at its inner end to said fuel passageway in said body portion for dispensing fuel into a vehicle fuel tank, said spout also including a vapor recovery passageway extending longitudinally therein and having at least one inlet opening adjacent the outer end of said spout and an outlet opening in said spout adjacent but spaced from the inner end of said spout, (c) vapor confinement means surrounding the inner end portion of said spout and sealingly engaging said spout and said egress end of said body portion and defining a vapor confinement chamber communicating with said exit opening of said vapor recovery passageway in said spout and with said vapor recovery passageway in said body portion, whereby vapor may be recovered from a vehicle tank by entering the vapor recovery passageway in said spout through the inlet opening passing through the spout and out through the outlet opening into the vapor confinement chamber and thence into said vapor recovery passageway in said body portion, (d) a check valve within said vapor confinement chamber, said check valve having an open condition, responsive to a positive pressure differential across said check valve between the end of said vapor recovery passageway adjacent said inlet opening and the end of said vapor recovery passageway adjacent the ingress end of said body portion and a closed condition to block liquid fuel flow through said check valve from the end of said vapor recovery passageway adjacent the ingress end of said body portion, (e) said check valve comprises a check valve body having a sealing seat on one surface thereof and a seal member having a first region cantileverly connected to said check valve body and a second region positioned so as to contact said sealing seat when said check valve is in the closed condition and wherein fuel vapor may pass through said check valve between said sealing seat and said seal member when said check valve is in the open condition, (f) said check valve body further includes a central opening surrounding said spout and is slidably mounted on said spout, and (g) said check valve body further includes a mating surface contacting said vapor confinement means so as to prevent fuel vapor from passing through said check valve between said mating surface and said vapor confinement means.

2. A fuel dispensing nozzle according to claim 1 wherein said check valve further comprises a mounting sealing means to prevent fuel vapor from passing through said check valve between said central opening of said check valve body and said spout.

3. A fuel dispensing nozzle according to claim 2 wherein said mounting sealing means comprises an O-ring mounted on said spout.

* * * * *